US007243890B1

(12) United States Patent
Hennessey et al.

(10) Patent No.: US 7,243,890 B1
(45) Date of Patent: Jul. 17, 2007

(54) DRY POWDER SERVICE UNIT AND METHOD OF USE THEREOF

(75) Inventors: Steven M. Hennessey, Argyle, NY (US); William S. Simard, West Sand Lake, NY (US)

(73) Assignee: United States of America as Represented by the Secretary of the Army, Washington, DC (US)

( * ) Notice: Subject to any disclaimer, the term of this patent is extended or adjusted under 35 U.S.C. 154(b) by 328 days.

(21) Appl. No.: 10/908,279

(22) Filed: May 5, 2005

(51) Int. Cl.
*A47K 1/08* (2006.01)
*A62C 11/00* (2006.01)
*A62C 25/00* (2006.01)

(52) U.S. Cl. ..... 248/313; 248/311.2; 248/312; 248/312.1; 169/30; 169/51

(58) Field of Classification Search ..... 169/30, 169/51, 54; 239/140; 248/311.2, 312, 312.1, 248/313
See application file for complete search history.

(56) References Cited

U.S. PATENT DOCUMENTS 4,586,687 A * 5/1986 Ziaylek, Jr. ..... 248/313
5,279,685 A * 1/1994 Ivansons et al. ..... 156/158
5,458,201 A * 10/1995 Brim ..... 169/26
6,543,736 B2 * 4/2003 Field ..... 248/313
6,651,751 B2 * 11/2003 Kluczynski ..... 169/51
6,830,226 B2 * 12/2004 Field et al. ..... 248/313

* cited by examiner

*Primary Examiner*—Davis Hwu
(74) *Attorney, Agent, or Firm*—Robert Charles Beam; John F. Moran

(57) ABSTRACT

A dry powder fire extinguisher recharging system charges and discharges a bottle with dry powder. The system includes a frame unit and various components associated with it, such as a clamp assembly to clamp a bottle assembly. The bottle assembly has a bottle in a pre-discharge or a discharge condition, and a valve. There are also components including locking plungers, a torque idler to torque and untorque the valve, a fill valve to recharge the bottle assembly, a fill gauge to pressurize the bottle assembly to the required pressures, a recharge line to charge the bottle assembly with the pressurizing agent, a discharge line to discharge a fully charged bottle, and a socket and an extension. The system also has a valve service area to re-service the valve, and a sprayer gun to remove dry powder residue from the valve during re-servicing of the valve.

13 Claims, 8 Drawing Sheets

DRY POWDER SERVICE UNIT AND METHOD OF USE THEREOF

FIELD OF THE INVENTION

The present invention relates to fire extinguisher recharging system that operates in a variety of uncontrolled environments. Specifically, the present invention relates to a dry powder fire extinguisher recharging equipment and process for recharging and discharging of extinguisher containers with fire extinguishing dry powder.

BACKGROUND OF THE INVENTION

Fire extinguishing typically involves either the temporary creation of an atmosphere that is incapable of sustaining combustion within the volume to be protected, or applying a stream of extinguishing agent to the base of the flame. Fire extinguishing is commonly practiced using portable fire extinguishers.

One fire extinguishing method in widespread use at present includes the introduction of volatile halocarbons (Halons), such as Halon 1301 or Halon 1211, for example, into the volume to be protected. Halons are known to interfere with the chemical reactions taking place in the flame and effectively inhibit the flame. Nevertheless, Halons suffer from a fundamental disadvantage; namely, they are known to interact with ozone, which leads to the destruction of the earth's ozone layer.

Ecologically benign fire extinguishing powders (dry powders) based on mineral salts, such as carbonates, bicarbonates, alkali metal chlorides, ammonium phosphates, and the like have been found to provide alternative volume fire extinguishing. These dry powders could successfully act to replace halocarbons or to enhance the performance of halocarbons or other commonly used extinguishing agents, such as $CO_2$ and the like. Dry powders possess a volume and local fire extinguishing effectiveness at least equal to that of halocarbons, yet are ecologically safe and nontoxic.

Fire extinguisher recharging equipment and methods for Halons and dry powders are known in the art. These conventional methods have been developed for controlled environments. However, fire extinguisher recharging equipment that operates in a variety of uncontrolled environments and that can be used for recharging containers with dry powders and Halons is needed for both civil and military purposes. Conventional systems often cannot satisfy sensitive mission capabilities for military purposes, for example. Further, conventional systems for recharging include multiple pieces of equipment representing a logistic impossibility for deployment with a battle group. Many of these pieces of equipment would not be mission capable, at least in that the commercial dry powder hoppers are cumbersome to use and are open to the atmospheric elements, thereby exposing dry powder to moisture.

Thus, there is an urgent need for a fire extinguishing recharging equipment that is mission capable and can encompass all aspects of the recharging process, including the discharging of full containers, and that can be modified for existing Halon units already in the field.

SUMMARY OF THE INVENTION

As described above, from the prior art known conventional equipment, the present invention includes new equipment different from the conventional equipment required for recharging and discharging charged dry powder containing containers. In an aspect, the present invention provides the ability to discharge fully charged bottles or cylinders and capture the powder, and to recharge the bottles or the cylinders without removing from the unit. The present invention also provides staging positions for various tasks, including discharge, torque, refill, recharge, visual inspection and evacuation of the dry powder residue. The design of the system disclosed herein can be modified for an existing Halon unit, thus creating of transportable hardware to meet civilian or military mission requirements for either Halon or dry powder.

In a specific embodiment, the present invention provides a dry powder fire extinguisher recharging system for charging and discharging bottles, cylinders or a suitable container, with dry powder. The system has a frame unit for accommodating various components. The various components may include a clamp assembly, locking plungers, a torque idler, a fill valve, a fill gauge, a recharge line, a discharge line, a socket and an extension.

The clamp assembly may have clamp arms capable of rotating 180°, and removable locking pins for locking in the clamp arms. The clamp assembly can clamp at least one bottle assembly with a bottle in a pre-discharge or a discharge condition. Locking plungers may lock the clamp assembly into various stages or positions, and a torque idler may torque and untorque a valve. A fill valve may control recharging of the bottle assembly to desired pressures with a pressurizing agent, such as dry nitrogen, and a fill gauge may pressurize the bottle assembly to the desired pressures.

An extension can slide in and out of the torque idler to engage the socket to an integrated hex of the bottle assembly, such as to torque or remove the valve. A recharge line charges the bottle assembly with the pressurizing agent, and a discharge line discharges a fully charged bottle unit. The recharge line maybe connected to a Schrader fitting on the bottle assembly during recharging, and the discharge line is connected to a discharge port on the bottle assembly during discharging.

The dry powder fire extinguisher recharging system may also have a valve service area by the frame unit to re-service the valve. The valve service area has a valve fixture that is mounted on a side table. In addition, the system can have a sprayer gun to remove dry powder residue from the valve during re-servicing of the valve, and a sprayer wand to evacuate dry powder residue from the bottle unit to a dust containment container. There may also be present a discharge hose to provide a flexible connection between the canister and either the discharge line or the sprayer wand. Further, a service valve may be for selecting a pressurizing agent (e.g., nitrogen or shop air) to service the sprayer wand or the sprayer gun. The fill valve may feed the service valve with a pressurizing agent.

Optionally, a dust collection bag may be used to diffuse the dry powder coming from the discharge hose, and to allow the dry powder to settle into the container. If the dust collection bag is used, the container should be sufficiently large to accommodate the dust collection bag.

Thus, the present invention provides for a fire extinguishing recharging equipment that is mission capable and can encompass all aspects of the recharging process, including the discharging of full containers, and that can be modified for existing Halon units already in the field.

DETAILED DESCRIPTION OF THE INVENTION

Figure 1:
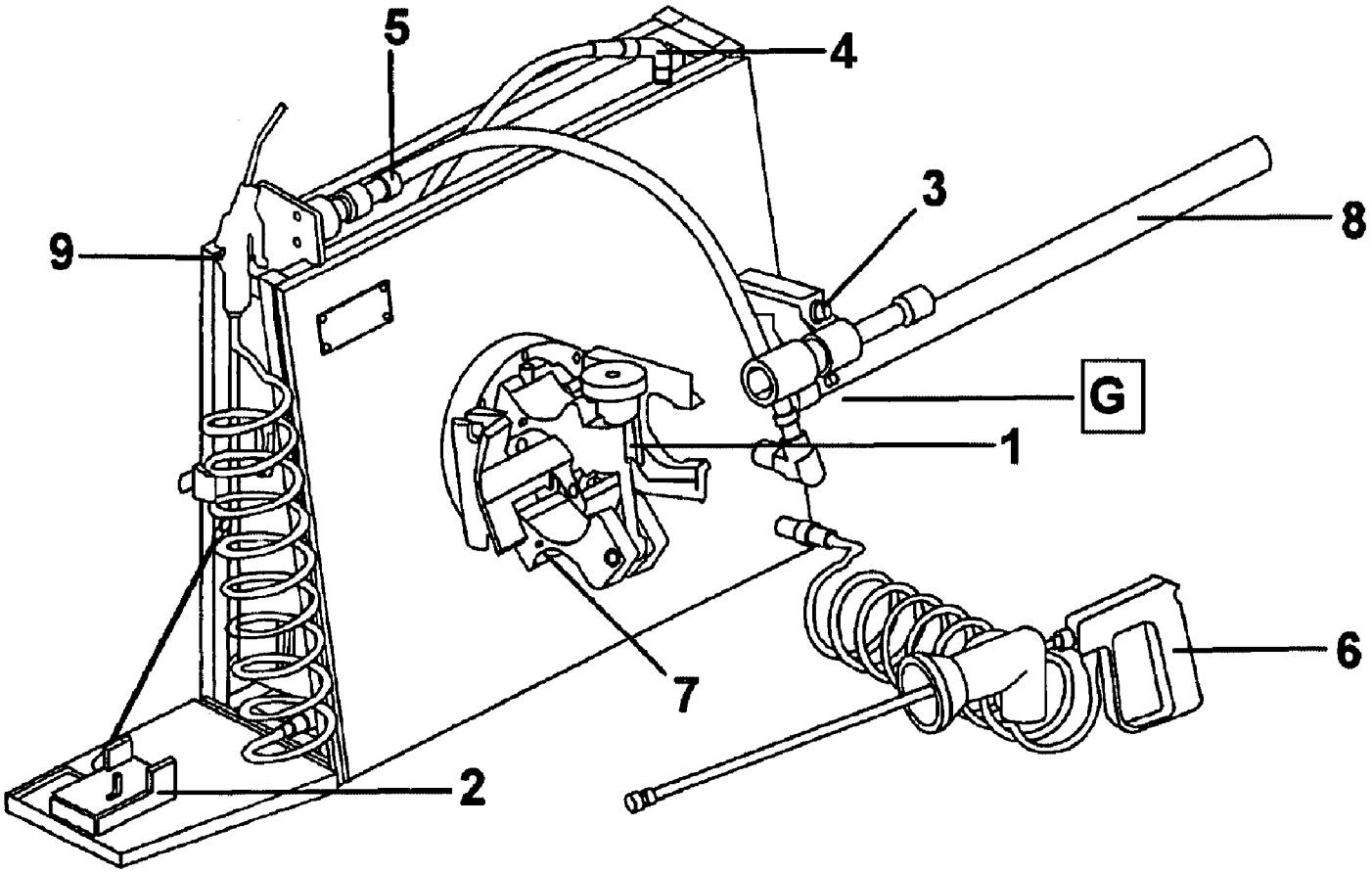
FIG. 1 is a configuration according to the present invention showing dry powder service unit.
Figure 2:
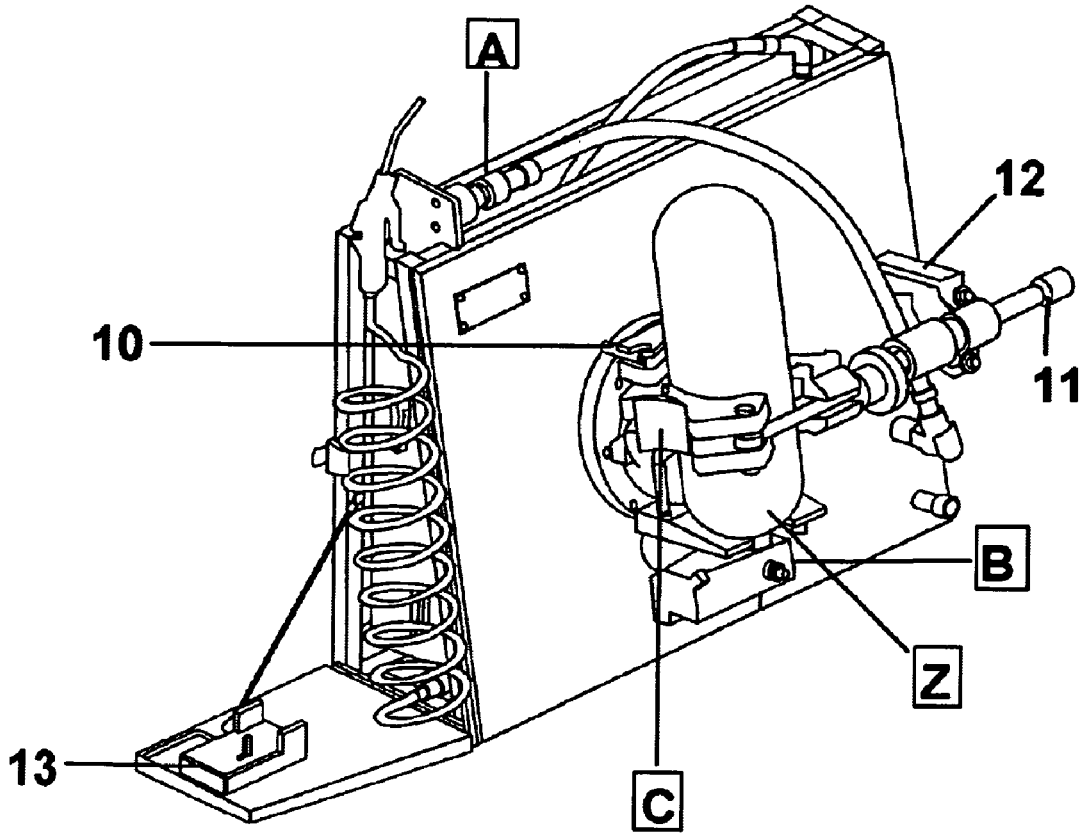
FIG. 2 is a configuration as in FIG. 1 during load, unload and discharge stage.
Figure 3:
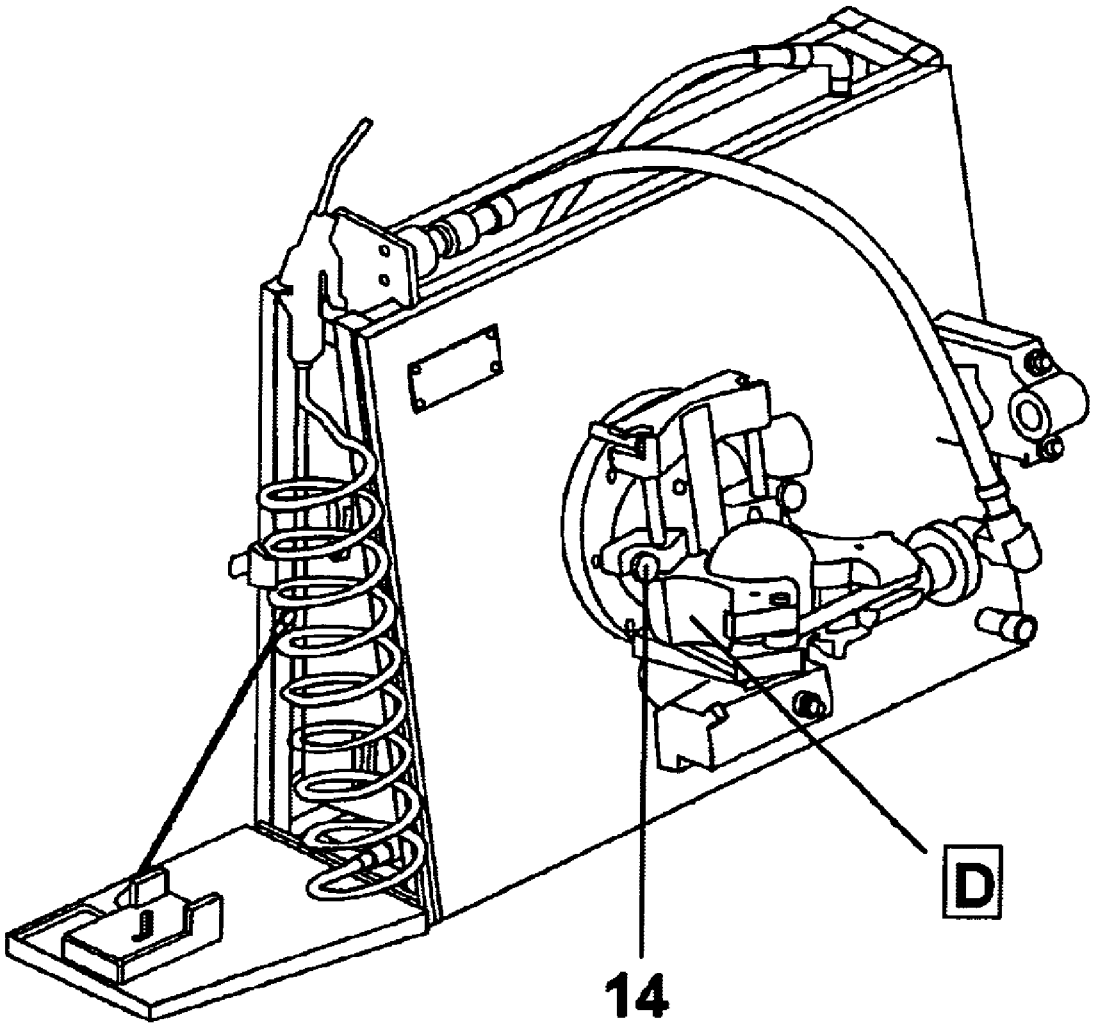
FIG. 3 illustrates another perspective view of dry powder service unit to show load, unload and discharge stage of a different size fire extinguisher bottle.
Figure 4:
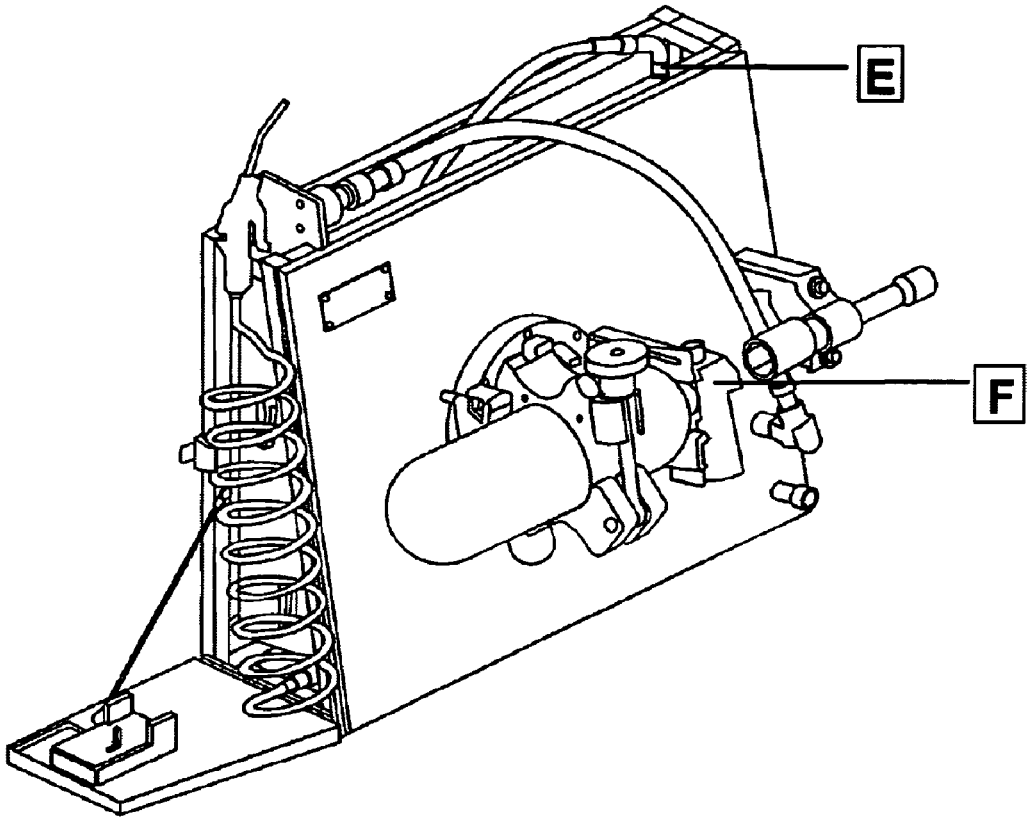
FIG. 4 illustrates a perspective view of dry powder service unit to show torque, valve removal and charging stage.
Figure 5:
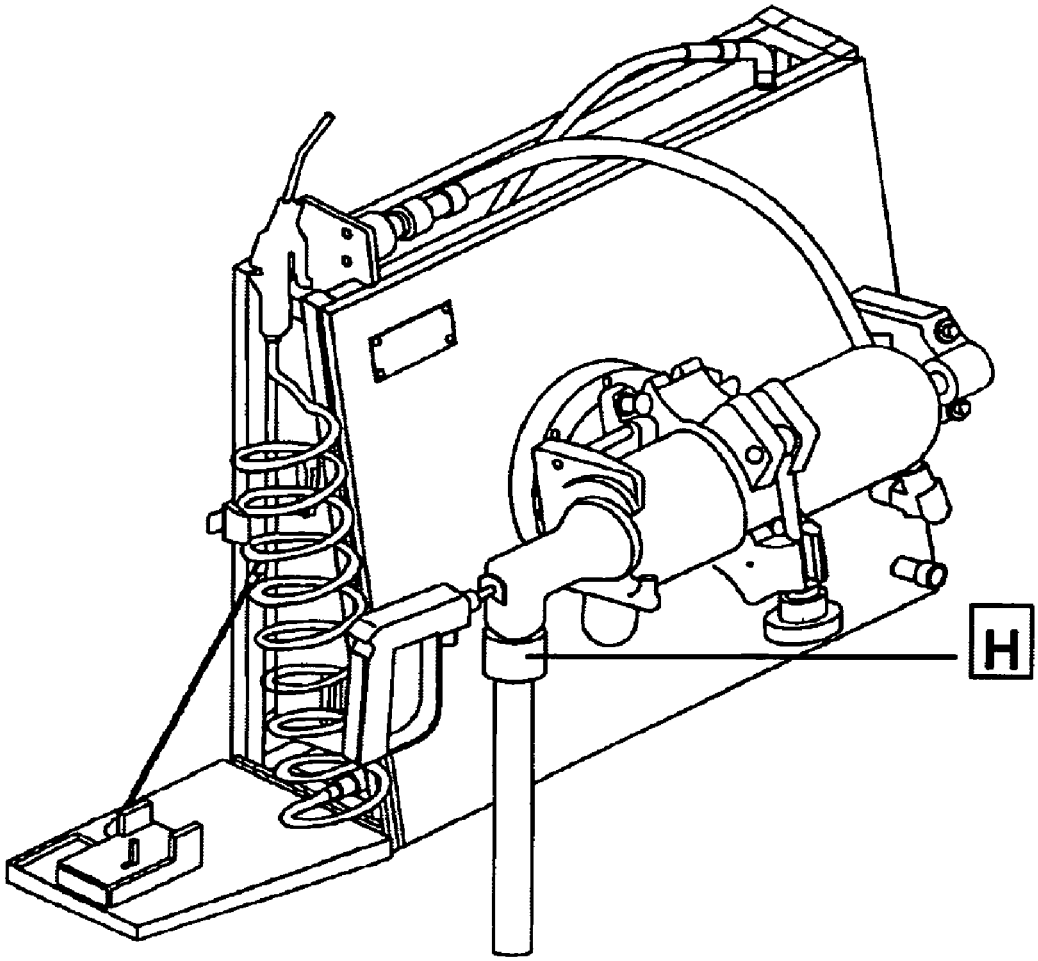
FIG. 5 illustrates a perspective view of dry powder service unit to show powder residue removal stage.
Figure 6:
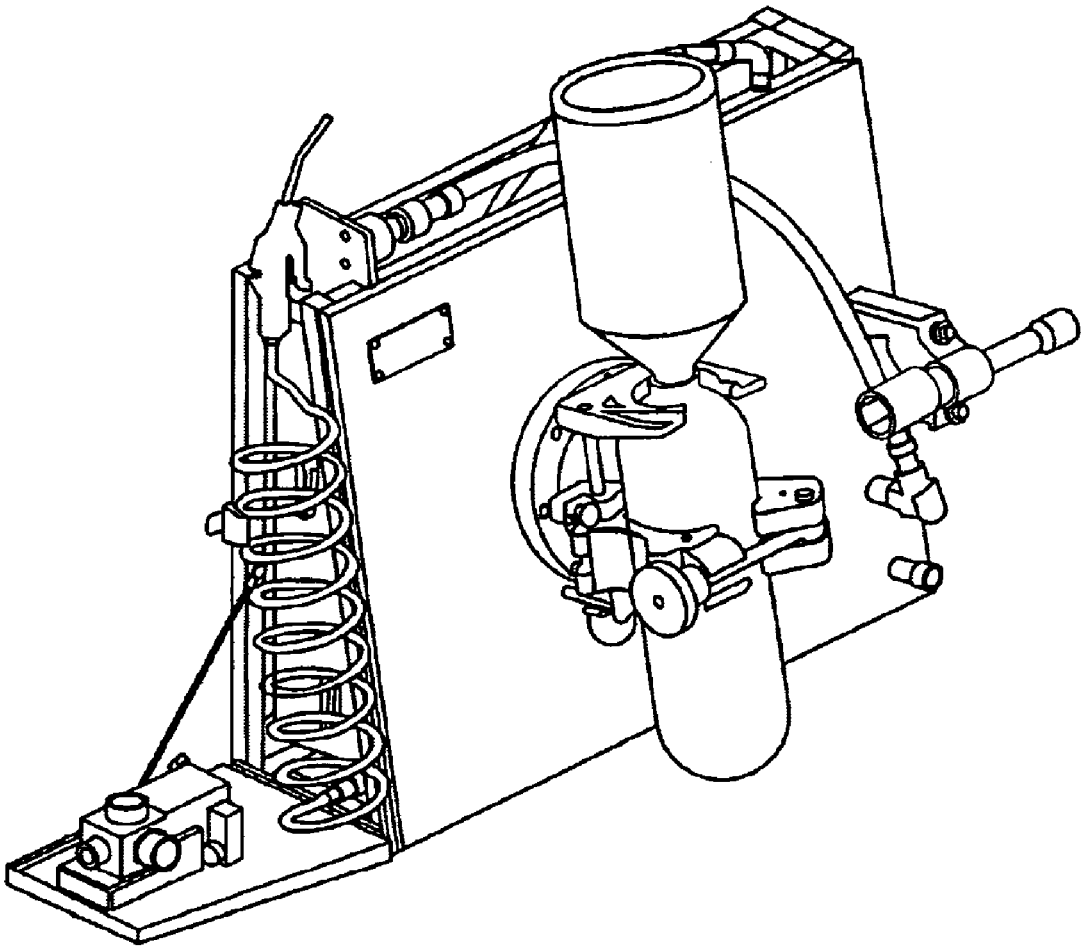
FIG. 6 illustrates a perspective view of dry powder service unit to show powder refill stage with pre-measured dry powder container.

An embodiment of the present invention is understood by referring to FIGS. 1-8. There is shown, in FIGS. 1-3, a dry powder service unit (DPSU) with a frame and various elements directly or indirectly connected to the frame. The frame of the unit can be tipped back. The various elements may include clamp assembly 1, valve service area 2, torque idler 3, recharge line 4, discharge line 5, sprayer wand assembly 6, mirrors 7, discharge hose 8, and sprayer gun valve 9, locking pins 10, extension 11, socket 12, valve fixture 13, and locking plungers 14. Variations of the illustrative embodiments of FIGS. 1-3 are shown in FIGS. 4-6.

The system illustrated in FIGS. 1-6, may provide a secure handling of the bottle assembly. Once clamped into the unit, it may not be necessary to remove the bottle until the recharge process is complete. The ability to discharge fully charged bottles and capture the powder, then recharge the bottle without removing from the unit, is included in the present invention clamping assembly 1 is adaptive to different bottle sizes (e.g., 2 and 12 lbs.), and the present invention may be modified to Halon extinguishing units, thus providing transportable hardware to meet extinguishing unit requirements for Halon or Dry Powder.

Full 360° rotation of the bottle and valve assembly can be achieved through the use of the present invention. As such, staging positions for various tasks, including discharge, torque, refill, recharge, visual inspection and evacuation of powder residue, may be provided.

Referring now in greater detail to FIG. 1, an embodiment of a dry powder service unit according to the present invention is illustrated. The clamp assembly 1 may be used to retain a bottle assembly, such as a bottle and valve assembly, during a discharge and recharging. The bottle of the bottle assembly is also referred to herein as the extinguisher bottle. The clamp assembly 1 may be so designed as to retain bottle assemblies of different sizes. In FIGS. 2 and 3, for example, one embodiment shows the bottle assembly may be adaptive to 2 and 12 pound cylinders. The valve service area 2 includes a valve fixture 13 that is mounted to a structure such as, for example, a side table. The valve service area provides an area to re-service the valve. The valve fixture 13 is used to hold the valve during servicing.

The torque idler 3 may be used to torque and un-torque the valve. The torque idler may remove any cantilever forces while applying the required torque to the valve. The recharge line 4 can be used to recharge the bottle via the valve with dry nitrogen. The discharge line 5 may be used to discharge a fully charged bottle. Discharging may be done when the bottles require preventive maintenance and are fully charged, thus requiring evacuation of the dry powder. Both the recharge and the discharge lines may be secured during transport by keeping them in the stowed position. When charging the bottle assembly, the recharge line may be connected to a Schrader fitting on the valve. Likewise, the discharge line, when in use, may be connected to a discharge port on the valve.

The sprayer wand assembly 6 can be used to evacuate any dry powder residue from the bottle to allow a visual inspection. For example, shop air or dry nitrogen may be used to expel the residue. A mirror 7 can be used to view the pressure gauge on the valve. The mirror may be of a convex type. The mirror and pressure gauge may assure the pressure has either been obtained during the refill process or is fully dissipated before removal of the valve from the bottle.

The discharge hose 8 provides a flexible connection between the canister and either the discharge line or the sprayer wand. When a bottle discharge is necessary, the hose can be connected to the discharge line, and during the discharge the powder may be captured into the canister assembly. The sprayer gun 9 may be used to access hard to reach places to evacuate the powder residue during the re-servicing of the valve. To evacuate the powder, either shop air or dry nitrogen may be used, as discussed herein above.

Referring now to FIG. 2, locking pins 10 may be used for locking in clamp arms. The locking pins are easily removed and installed for the purpose of switching the clamps for different size bottles (e.g., 2 and 12 pound bottles). The extension 11 is a common socket extension and the socket 12 may be, for example, a 1½ inch standard deep socket, used in conjunction with the extension. The extension slides in and out of the torque idler so the user can engage the socket to the integrated hex of the valve to torque the valve. The valve fixture 13 may be used to hold the valve during required servicing.

Referring now to FIG. 3, spring loaded locking plungers 14 are shown. These may be used to lock the clamping device or clamp assembly into various stages or positions. The locking plungers may be disengaged prior to rotation of the clamp assembly. The locking plungers may be disengaged by manual extraction, for example.

Figure 7:
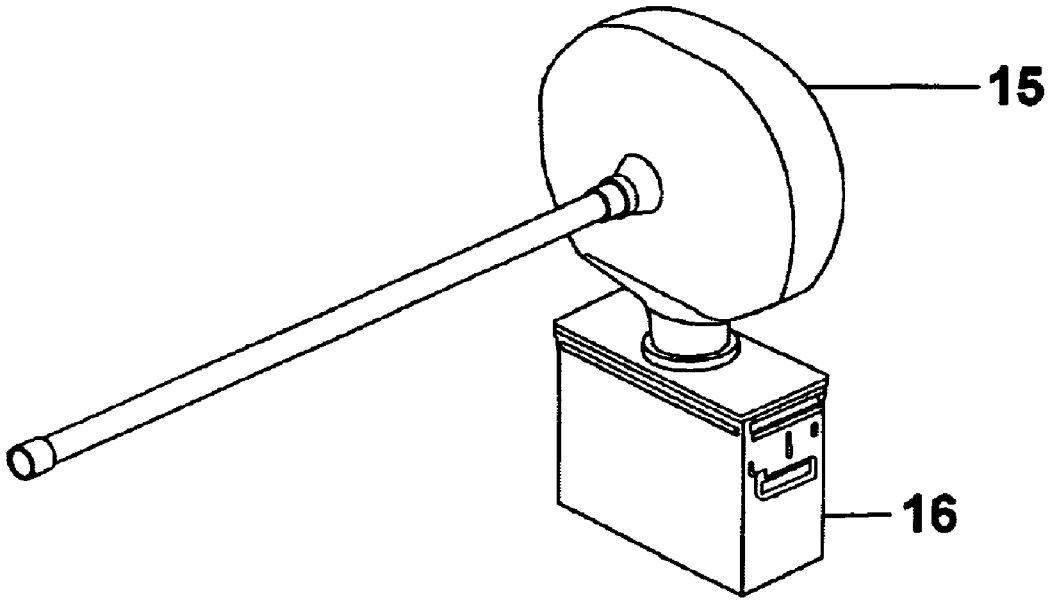
FIG. 7 illustrates a discharge canister.
Figure 8:
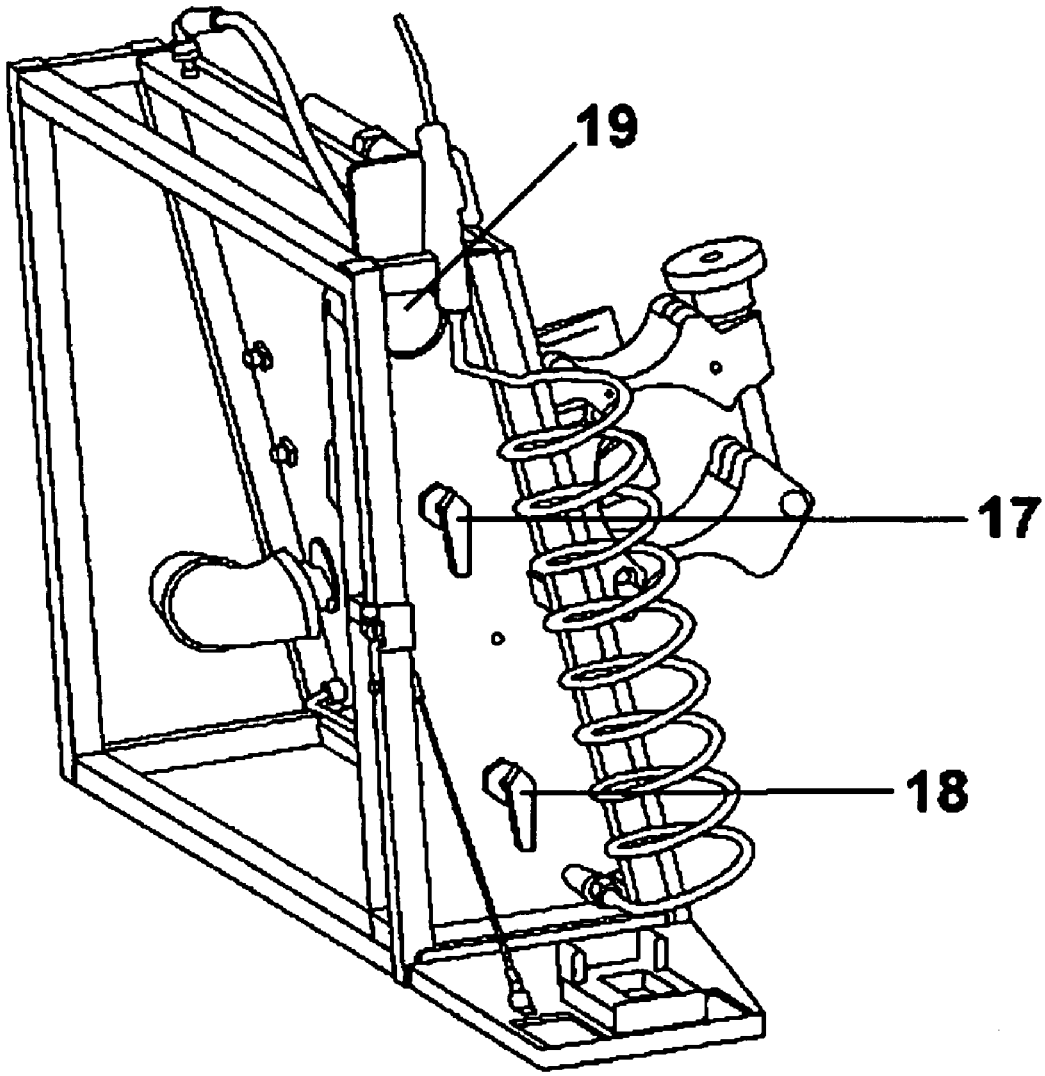
FIG. 8 is a schematic depiction of dry powder service unit operator's station (view turned for clarity).

Illustrated in FIG. 7 is an embodiment of a discharge canister, and FIG. 8 illustrates a dry powder service unit in accordance with the present invention. The discharge canister may have a dust collection bag 15, preferably of canvass material, and a dust containment canister. In situations where powder is extremely fine and tends to become air borne particulates, the dust collection bag may diffuse the powder coming from the discharge hose and allow it to settle into the dust containment canister 16. The dust containment canister 16 may be a recycled ammunition container modified to accommodate the canvas bag and to have good sealing properties, for example. The discharge canister may be portable. It may have handles for use when discarding the powder.

The valve 17, illustratively shown in FIG. 8, may be a three-way valve. The valve may be used to recharge the bottle to required pressures with dry nitrogen. The valve may also feed the service area valve with nitrogen in the event that there is no shop air, thereby allowing valve servicing to be accomplished and bottle recharging to be completed. The service valve 18 may be used for selecting nitrogen or shop air to service the sprayer wand and valve sprayer gun. Shop air may be used in most instances, but if shop air is not available, the valve 18 may be switched to nitrogen. The fill gauge 19 may also be provided to allow for viewing by the operator to pressurize the bottle assembly to the required pressures.

The dry powder service unit according to the present invention may be used in conjunction with conventional fire extinguishers, such as those based on the release of pressurized $CO_2$ or $N_2$. Conventional fire extinguishers containing $CO_2$ or $N_2$ and various mixtures of inert gases are limited in the ability to effectively deliver contents in open spaces. To overcome this limitation, such a conventional fire extinguisher may have added thereto, the dry powder extinguishing capabilities described herein, thereby increasing the fire extinguishing effectiveness of the device and reducing the concentration of conventional, and environmentally unfriendly, fire extinguishing agents required for effective fire fighting.

Operation of the system can be more readily understood by reference to FIGS. 1-8. The operation of the system may include the steps of loading, bottle discharge, valve removal, bottle cleaning, bottle refill, valve torque, and bottle removal.

Loading: The operator may determine which bottle size (e.g., 2 or 12 pound bottle) requires servicing. Once the bottle size is determined, the operator may check the clamp arms for proper setting. One may need to change the clamp arms depending on the size of the bottle being changed. For example, changing from a 12 to a 2 pound bottle, or vice versa, may require the change of the position of the clamp arms. The operator may grasp one of the arms of the clamp assembly 1 and turn the locking pin 0° to 90°. The locking pin may be pulled straight up and out. The operator may then rotate the arm 180° from position "C" (see FIG. 2) to position "D" (see FIG. 3) and reinsert the pin and lock. The above procedure may be repeated with the other arm. Once this procedure is accomplished, the operator can load the bottle assembly into the clamp assembly, such as by straddling the clamp between the bottle and the valve (detail "Z" in FIG. 2). The clearance between the clamp and bottle assembly may be precise and may thus prevent the bottle assembly from falling out. The frame of the dry powder service unit may be tipped back at 10° so the bottle is cradled in the clamp. The operator may load and clamp the bottle assembly (such as with gauge facing inward) by using the hand knob, applying only hand force (FIG. 3).

Bottle Discharge: For bottle discharge (e.g., 2 or 12 pound bottles), the discharge hose 8 may be placed in the discharge "G" position (FIG. 1). The operator may remove the safety cap on the discharge port of the valve body. The operator then may remove the discharge line 5 form the stowed position "A" (FIG. 2) to the discharge port on the valve position "B" (FIG. 2), and may secure. The operator can then safely discharge the valve manually. Within a few seconds of this operation, the powder is captured in the discharge canister assembly 15 and 16. The discharge phase is thus completed. The operator may remove the discharge line and return it to the stowed position.

Valve Removal/Service: The valve may be removed (FIG. 4). To remove the valve, the operator may manually disengage the locking plungers 14 and rotate the clamp assembly into the 3 o'clock position for valve removal. The operator may release the pins and check that the clamp assembly is locked. The operator may then slide the extension 11 with socket 12 over an integrated nut, such as a hex nut, on the valve body. The operator may apply a socket wrench to other end of the extension and turn the wrench to break the valve free. The operator may then slide back the extension and socket and remove both from the torque idler. The operator may then disengage the locking plungers and turn the clamp assembly to the 12 o'clock position. The valve can be manually unscrewed by hand from this position. The operator may then place the valve into the valve fixture 13 (See FIGS. 2 and 6) and remove the safety cap and pin lanyard assembly. The operator may set the service valve 18 to shop air, and if shop air is not available the operator may set the valve to nitrogen, and may turn the fill valve 17 to service. This may allow the operator to use nitrogen to service the valve and use the sprayer wand.

Bottle Cleaning And Visual Inspection: For bottle cleaning, the operator may disengage the locking plungers and rotate the assembly to the 9 o'clock position, as shown in FIG. 5. The operator may then remove the discharge hose from position "C" shown in FIG. 1 and connect it to position "H" of the sprayer wand assembly 6. The operator may insert the wand assembly into the bottle opening and, while squeezing the trigger, may slide the wand in and out of the housing thereby evacuating the powder from the bottle through the housing down the hose and into the canister assembly. If desired, the operator may remove the sprayer wand assembly and perform a visual inspection of the bottle.

Bottle Refill And Valve Reinsertion: To fill the extinguisher bottle with dry powder, the operator may turn the clamp assembly to the 6 o'clock position and thread into the extinguisher bottle a pre-measured refill bottle. The pre-measured refill bottle (shown in FIG. 6) contains dry powder to be transferred to the extinguisher bottle. The pre-measured refill bottle may be made of plastic, for example. The pre-measured refill bottle may be kept sealed until used in order to protect the contents from being contaminated. The assembly may be turned clockwise to the 10:30 clock position, allowing the powder to transfer from the refill bottle to the extinguisher bottle. During the powder transfer, the valve may be serviced per valve procedures. The operator may use the valve service gun 9 to evacuate any powder residue from the valve, such as by turning the service valve 18 to shop air. As described above, if shop air is not available, the fill valve may be turned to service and the service valve to nitrogen. The operator then can proceed with servicing the valve as required. Then the assembly may be turned to the 12 o'clock position for final powder transfer. After all powder has been transferred, the refill bottle can be removed and the valve reinserted, assuring the safety cap and pin wire has been installed around the neck of the bottle. The valve may be threaded by hand until the o-ring has contacted the bottle, for example.

Valve Torque/Charging: To apply torque, the clamp assembly is turned into the 3 o'clock position (FIG. 4). The operator may then slide the extension into the torque idler, apply the socket and engage the integrated hex of the valve body. The operator may apply torque wrench to the other end of the extension and thereby, torque the valve onto the bottle at about 200-50 ft/lb. Once full torque is applied the recharging of the bottle/valve assembly can be performed. The operator may apply the safety cap to the discharge port of the valve, and may insert the safety pin into the manual discharge lever, and may remove the protective cap from the Schrader fitting. The operator may then remove the recharge line 4 from position "E" to position "F" (FIG. 4) and secure it onto the Schrader fitting. The operator may then set the pressure required for charging on the regulator of the nitrogen tank, and may turn the fill valve 17 to the fill position. This is done to pressurize the fill gauge 19. The operator may recheck pressure setting for accuracy, and if necessary adjust regulator until pressure setting is accurate. Once pressure setting is accurate, the operator may open the Schrader-fitting valve, allowing the nitrogen to enter the bottle valve assembly. The operator may check the gauge on the valve body to assure equalization and full pressurization of the bottle. The Schrader fitting valve and fill valve may then be closed. The recharge line is then removed from Schrader fitting and stowed.

Bottle Removal: To remove a fully recharged bottle assembly from the DPSU, the assembly may be turned to the 6 o'clock position and the bottle unclamped from the clamp assembly.

Based on the above procedures for a fully charged bottle, one skilled in the art may operate the DPSU in situations involving an already discharged bottle, a partially discharged bottle or a charged bottle.

While this invention has been described with a reference to specific embodiments, it will be obvious to those of ordinary skill in the art that variations in the systems and methods disclosed herein may be used. It is thus intended that the invention may be practiced otherwise than as specifically described herein. Accordingly, this invention includes all modifications encompassed within the spirit and scope of the invention as defined by the claims.

What is claimed is:

1. A dry powder fire extinguisher recharger for charging and discharging a fire extinguisher, comprising:

a clamp assembly comprising clamp arms capable of rotating 180°, removable locking pins for locking in the clamp arms and: a bottle in one of a pre-discharge and a discharge condition;

locking plungers to lock the clamp assembly into one of a plurality of available stages;

a valve to allow recharging of the bottle assembly to a required pressure with a pressurizing agent, including at least one Schrader fitting;

a torque idler to torque the valve;

a recharge line connected during recharging, to Schrader fitting;

a discharge line to discharge connected, during discharging, to the valve; and a socket with extension capable of sliding in and out of the torque idler to engage the socket on to the bottle to torque the valve.

2. The dry powder fire extinguisher recharger of claim 1, further comprising a valve service to re-service the valve, wherein the valve service comprises a valve fixture mounted to a side table.

3. The dry powder fire extinguisher recharger system of claim 2, further comprising a sprayer gun to remove dry powder residue from the valve during re-servicing of the valve.

4. The dry powder fire extinguisher recharger of claim 1, further comprising a sprayer wand to evacuate dry powder residue from the bottle to a dust containment container.

5. The dry powder fire extinguisher recharger of claim 4, further comprising a flexible one of the discharge line to provide a flexible connection between the bottle and the sprayer wand.

6. The dry powder fire extinguisher recharger of claim 5, further comprising a dust collection bag to diffuse powder from the discharge line and to allow the powder to settle into a dust collection bag.

7. The dry powder fire extinguisher recharger of claim 4, further comprising the valve being capable of selecting a pressurizing agent selected from the group consisting of nitrogen and shop air.

8. The dry powder fire extinguisher recharger of claim 1, further comprising a fill gauge.

9. The dry powder fire extinguisher recharger of claim 8, further comprising a mirror to view the fill gauge.

10. The dry powder fire extinguisher recharger of claim 1, wherein the bottle is a 2 or 12 pound cylinder.

11. The dry powder fire extinguisher recharger of claim 1, wherein the pressurizing agent is dry nitrogen.

12. The dry powder fire extinguisher recharger of claim 1, wherein the pressurizing agent is shop air.

13. The dry powder fire extinguisher recharger of claim 1, wherein the locking plungers are spring loaded.

* * * * *